US008138948B1

(12) United States Patent
Votava et al.

(10) Patent No.: US 8,138,948 B1
(45) Date of Patent: Mar. 20, 2012

(54) AUTOMATICALLY ENGAGED TRAFFIC SIGN

(75) Inventors: Mark C. Votava, Downers Grove, IL (US); Timothy E. Paulin, Westmont, IL (US)

(73) Assignee: Timothy E. Paulin, Westmont, IL (US)

( * ) Notice: Subject to any disclaimer, the term of this patent is extended or adjusted under 35 U.S.C. 154(b) by 371 days.

(21) Appl. No.: 12/566,904

(22) Filed: Sep. 25, 2009

Related U.S. Application Data

(60) Provisional application No. 61/121,652, filed on Dec. 11, 2008.

(51) Int. Cl.
*G08G 1/07* (2006.01)

(52) U.S. Cl. ..... 340/927; 340/916; 340/931

(58) Field of Classification Search ..... 340/906, 340/907, 908, 914, 916, 927, 931, 815.4; 40/475, 610; 116/63 P, 63 R; 359/536, 546
See application file for complete search history.

(56) References Cited

U.S. PATENT DOCUMENTS

| | | | | |
|---|---|---|---|---|
| 3,210,728 | A * | 10/1965 | Davis et al. | 340/928 |
| 3,848,562 | A * | 11/1974 | Downing | 116/63 R |
| 5,175,646 | A * | 12/1992 | Eden | 359/536 |
| 6,897,786 | B1 * | 5/2005 | Kalt et al. | 340/815.4 |
| 6,940,092 | B2 * | 9/2005 | Yoshida et al. | 257/40 |
| 2006/0050018 | A1 * | 3/2006 | Hutzel et al. | 345/60 |

FOREIGN PATENT DOCUMENTS

JP 100337137 A * 2/1998

* cited by examiner

*Primary Examiner* — Van T. Trieu

(57) ABSTRACT

The present invention describes a sealed, automatic sign that displays a traffic sign (such as a stop or yield sign) visible when the power to the sign is interrupted. The sign has a shade, which covers the stop sign within the frame work while the power is on. When the power is interrupted, the shade lowers, revealing the traffic sign. When power is returned the shade is then drawn up to its original state, concealing the traffic sign.

11 Claims, 6 Drawing Sheets

Power On, Shade Up

Power Off, Shade Down

AUTOMATICALLY ENGAGED TRAFFIC SIGN

PRIORITY CLAIM

This application claims priority from Provisional Patent Application Ser. No. 61/121,652, filed Dec. 11, 2008, which is hereby incorporated in this application in its entirety.

TECHNICAL FIELD

This invention relates generally to traffic signals, and more particularly to signals that function in the event a power failure renders powered traffic lights inoperative.

SUMMARY OF THE INVENTION

The present invention comprises a sealed, automatic sign that displays a traffic sign (such as a stop or yield sign) visible when the power to the sign is interrupted. The sign has a shade, which covers the stop sign within the frame work when the power is on. When the power is interrupted, the shade lowers, revealing the traffic sign. When power is returned the shade is then drawn up to its original state, concealing the sign.

Unique features of the present invention include extremely simple design without mechanical linkages that can fail over long periods of time and a method to keep the sign closed without using power (prior art designs continue to use power to keep the signs closed; a disadvantage for signage that operates for a brief period via backup battery supplies). Unlike other signs in the prior art that deploy upon a power outage, the present invention is sealed from the elements, so that the mechanism that operates to reveal the traffic sign upon power failure is protected from severe weather conditions (such as snow and ice) that may have caused the power failure in the first place, as well as other environmental conditions that may inhibit function, such as mold or insect infestations. Unlike many other inventions in the prior art, the present invention will also automatically return to a "closed" position (concealing the traffic sign) when power is restored. It does not rely upon gravity to either open or close.

Perhaps the most unique and useful feature of the present invention is its simplicity. Unlike similar devices known in the art, it covers the traffic sign when not in use with a single curtain with four bearing points, reducing the number of bearings and linkages required, and thus reducing the potential for frame distortion when the sign is subjected to severe environmental conditions. The present invention also features a single rotary motor to lift the curtain, and consumes minimal power when not in use. The only moving parts are the items described below.

Optionally, the sign may be equipped for greater visibility with LED lights to highlight the word "STOP" or "YIELD" in the traffic sign, as well as the border of the sign. The LED lights require little power and can be powered by a battery, which in turn may optionally be kept charged by a solar cell. These LEDs may emit a steady light or may flash to draw attention to the sign.

Thus, it is an object of this invention to provide an emergency sign that is actuated by a loss of power.

It is also an object of the present invention to provide an emergency sign that will function indefinitely without power rather than relying upon an auxiliary source of power.

Other objects, features and advantages of the present invention will become apparent upon reading the following specification when taken in conjunction with the accompanying drawings.

DESCRIPTION OF A PREFERRED EMBODIMENT

Figure 1:
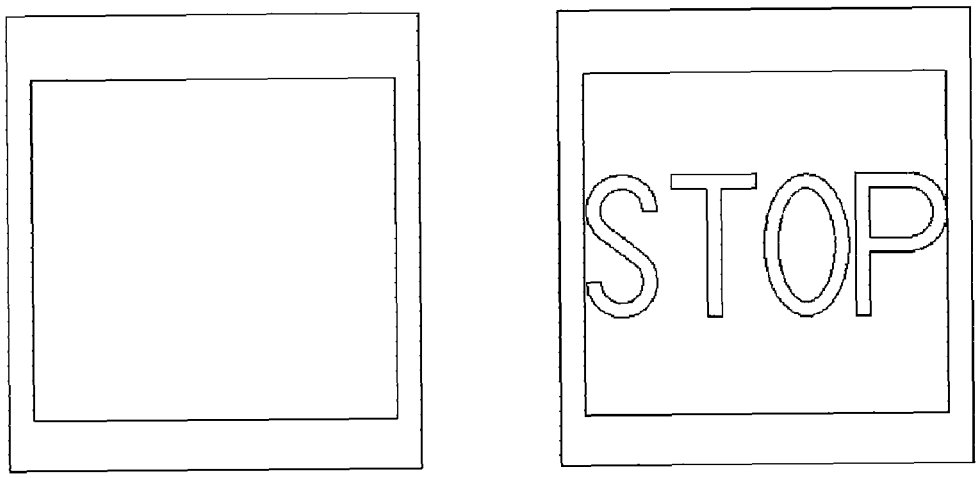
FIG. 1 shows a front view of a preferred embodiment.

The accompanying drawings illustrate a complete embodiment of the invention according to the best modes so far devised for the practical application of the principles thereof, and in which:

FIG. 1 shows a front view of the unit illustrating that the shade is up when power is on, and drops down when power failure has occurred revealing the stop sign.

Figure 2:
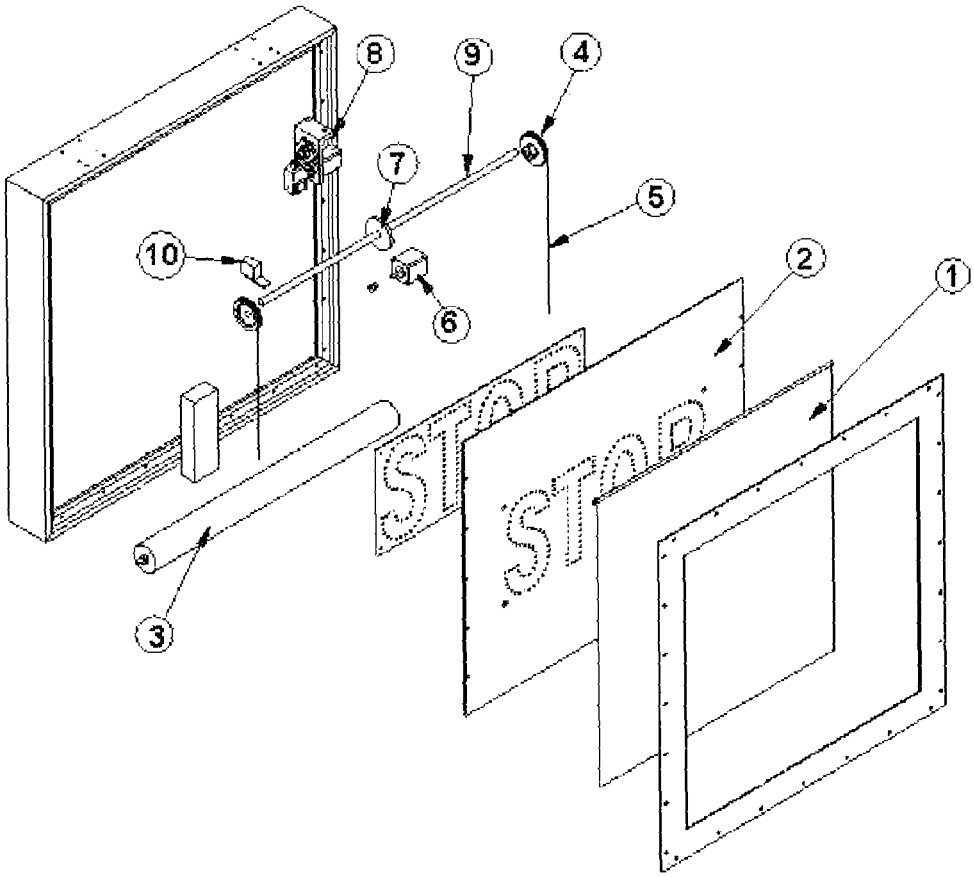
FIG. 2 shows an exploded view of a preferred embodiment.

FIG. 2 shows an exploded view of the unit illustrating the components and mechanisms that operate the sign. When power has been restored, the motor 6 spins the gears 7 on the shaft 9 thus rotating the pulleys 4. The rotating pulleys wind the cables 5 up, which are attached to the top of the shade 1. This in turn causes the shade to rise from its roller 3 until it his the upper limit switch 10. The electronics then allow the shade to drop until the latch mechanism 8 catches, locking the shade in place, concealing the traffic sign 2.

Figure 3:
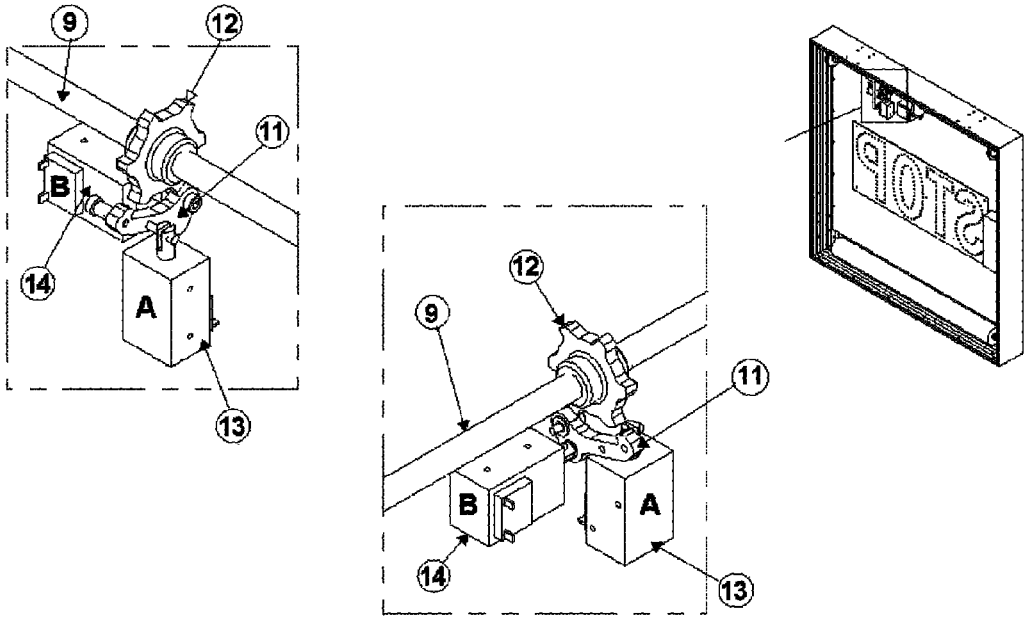
FIG. 3 shows a rear view of a preferred embodiment.

FIG. 3 shows a rear view of the unit as a whole and a detailed diagram of the mechanism that holds the shade up. While power is on, the latch 11 catches one of the fingers of the cam 12, which is attached to the shaft 9. This in turn locks the shade in the "up" position concealing the traffic sign. When a power failure occurs, there is enough of a charge held in the caps on the circuit board to activate solenoid A 13. When solenoid A pulls the latch 11 down, solenoid B's spring-loaded plunger 14 locks the latch in the down position. When the latch 11 is down, the shade is allowed to fall. The shade drops with the spring-loaded tension from the roller, as shown in FIG. 2, thus revealing the traffic sign.

Figure 4:
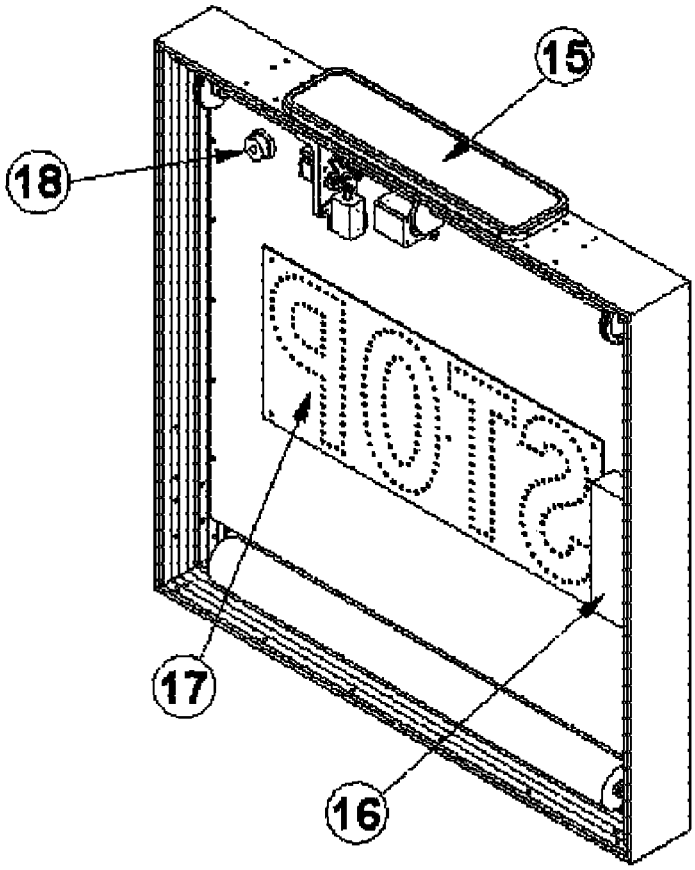
FIG. 4 shows the complete LED system for a preferred embodiment.

FIG. 4 displays the complete LED system. The solar panel 15 collects power to be stored in the storage battery 16 to power the LEDs 17 on the STOP sign. When a power failure does occur the shade will drop and a photosensor 18 determines whether it is day or night. If it is dark, the LEDs will be activated, illuminating the traffic sign to increase its visibility.

Figure 5:
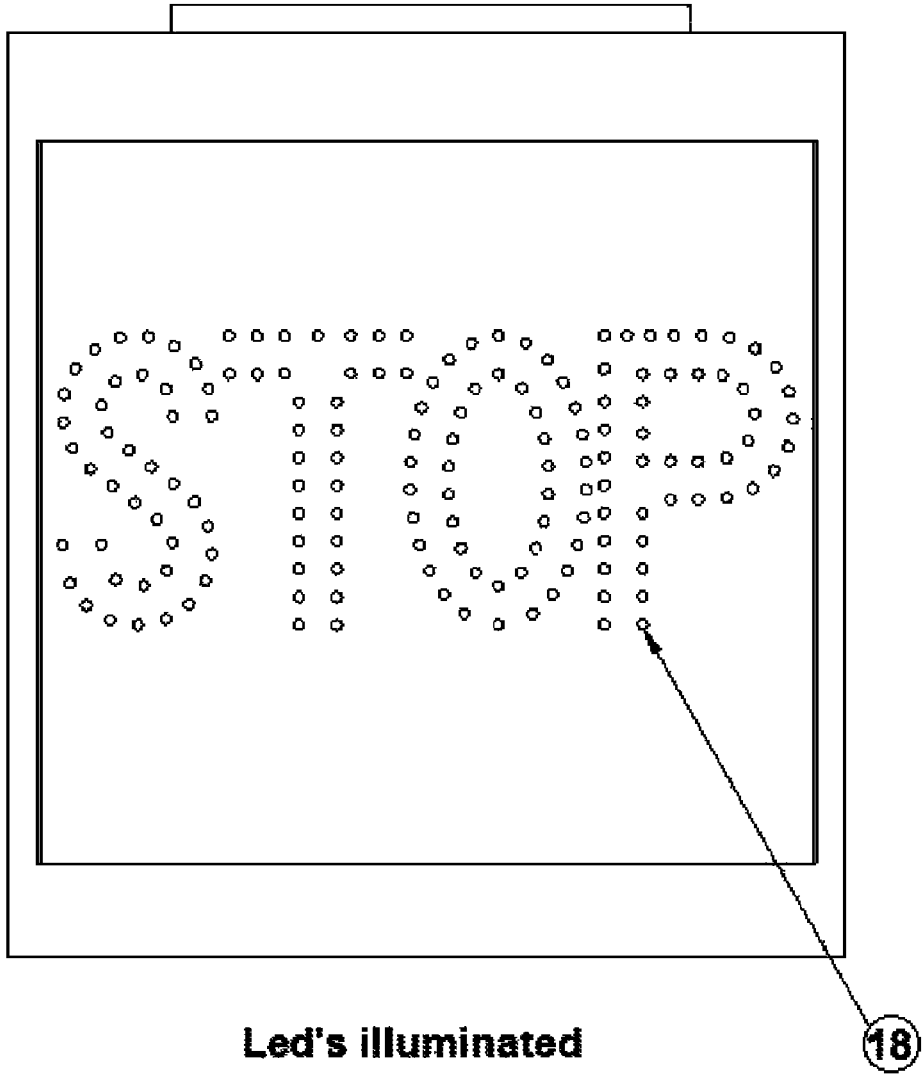
FIG. 5 shows a front view with LED's illuminated.

FIG. 5 displays a front view of what the sign would look like with the LEDs illuminated.

Figure 6:
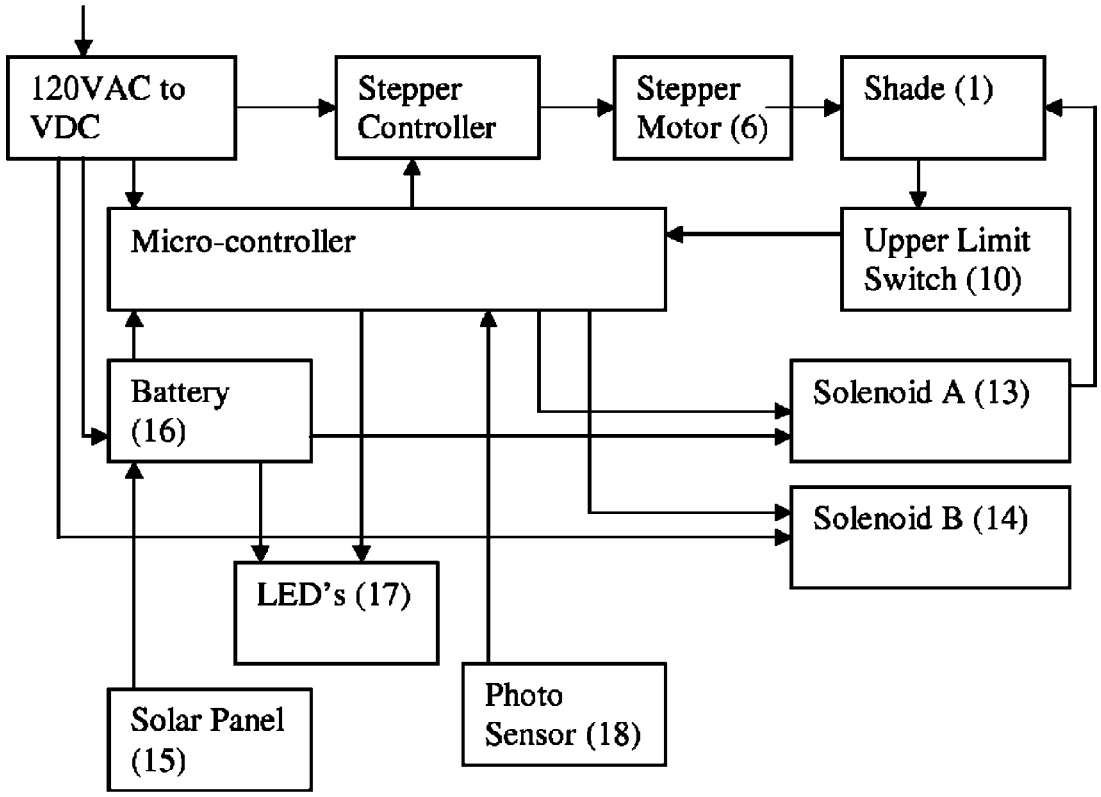
FIG. 6 shows a wiring diagram for a preferred embodiment.

FIG. 6 shows the wiring diagram. First, 120 Volts AC of electricity enters, and is converted to DC voltage to power the stepper motor 6, solenoids 13 and 14, micro-controller, and trickle-charge the battery. The stepper controller is used to operate the stepper motor 6. The motor is used to raise the shade 1. Once the shade is fully raised it triggers the upper limit switch 10. This tells the micro-controller to stop the motor. Once the motor is stopped the shade is allowed to roll back enough for the mechanical latch 8 to engage. When the micro-controller detects AC power is unavailable, backup power is used to operate solenoid B14. This releases the latch allowing the shade 1 to fall. Once the micro-controller detects AC power is available, solenoid B14 is operated to hold the latch out of the way while the process above is repeated. While the AC power is unavailable, the micro-controller can turn on the LEDs.

Possible variations on this design include the use of additional LEDs to enhance the visibility of the sign, as well as the use of other traffic signs, such as yield signs. In one arrangement of signs on a road at an intersection (not shown), one lane of travel could display stop signs in each direction at the intersection, while the other lane of travel displays yield signs.

What is claimed is:

1. An automatically engaged traffic sign comprising a traffic sign;

a curtain to conceal the traffic sign;

a spring-loaded roller for rolling up the curtain when the traffic sign is to be displayed;

a cable attached to the curtain;

a pulley for winding the cable to draw the curtain into a closed position;

a motor attached to said pulley;

a cam with at least one finger that is rigidly connected to the pulley;

a latch disposed to engage the finger on the cam when the curtain is in a closed position;

an actuating mechanism to disengage the latch when a power failure is detected.

2. The traffic sign of claim 1, further comprising a weather-resistant container.

3. The traffic sign of claim 1, further comprising a spring-loaded plunger for locking the latch in a disengaged position.

4. The traffic sign of claim 1, in which the actuating mechanism is a solenoid.

5. The traffic sign of claim 1, further comprising a shaft connected to the pulley and the cam.

6. The traffic sign of claim 1, further comprising a plurality of LEDs for lighting the sign.

7. The traffic sign of claim 6, further comprising a battery to power the LEDs.

8. The traffic sign of claim 7, further comprising a solar cell to charge the battery.

9. The traffic sign of claim 6, further comprising a light sensor for controlling the LEDs.

10. The traffic sign of claim 6, in which the LEDs flash to draw attention to the traffic sign.

11. The traffic sign of claim 1, further comprising an upper limit switch for detecting when the curtain is fully raised to a closed position.

* * * * *